US006384355B1

(12) United States Patent
Murphy et al.

(10) Patent No.: US 6,384,355 B1
(45) Date of Patent: May 7, 2002

(54) PARALLEL GUIDE MECHANISM FOR A SWITCH

(75) Inventors: Morgan D. Murphy, Kokomo; Kurt F. O'Connor, Carmel, both of IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/944,617

(22) Filed: Sep. 4, 2001

(51) Int. Cl.[7] ..... H01H 13/70
(52) U.S. Cl. ..... 200/344
(58) Field of Search ..... 200/5 A, 517, 200/341, 343, 344, 345; 400/490, 491, 491.2, 495, 495.1, 496

(56) References Cited

U.S. PATENT DOCUMENTS 3,940,578 A * 2/1976 Pointon ..... 200/5 A
6,153,844 A * 11/2000 Hyono et al. ..... 200/343
6,156,985 A 12/2000 Chiang ..... 200/344
6,175,090 B1 1/2001 Blossfeld ..... 200/558
6,207,907 B1 * 3/2001 Gillig et al. ..... 200/5 A
6,260,936 B1 * 7/2001 Frank et al. ..... 200/343

* cited by examiner

*Primary Examiner*—Michael Friedhofer
(74) *Attorney, Agent, or Firm*—Jimmy L. Funke

(57) ABSTRACT

A parallel guide mechanism includes a peripheral housing and a central mass, for accepting a mechanical input from a user, located within the peripheral housing. The central mass moves responsive to the mechanical input. A first beam and a second beam horizontally separated by a gap and substantially located in a first plane extend from a first vertical surface of the central mass and connect the central mass to a first inner vertical surface of the peripheral housing. A third beam located in a second plane is vertically spaced apart from the first and second beams and is horizontally positioned in the first gap between the first and second beams and extends from the first vertical surface of the central mass and connects the central mass to the first inner vertical surface of the peripheral housing.

20 Claims, 3 Drawing Sheets

PARALLEL GUIDE MECHANISM FOR A SWITCH

TECHNICAL FIELD

The present invention is generally directed to a parallel guide mechanism and, more specifically, a parallel guide mechanism for a switch.

BACKGROUND OF THE INVENTION

A variety of automotive accessories, e.g., an automotive radio, within a motor vehicle employ button switches. Traditionally, buttons for the button switches have been fabricated and decorated (i.e., painted and laser trimmed) individually. The buttons are then set in a separate housing that includes a plurality of integrally formed guides for accepting the buttons. Unfortunately, each of the buttons has required individual fabrication and decoration, which significantly increases the total cost of an end product so designed. Further, as the individual buttons are actuated, they can produce a squeaking noise due to the fact that each of the individual buttons includes a number of posts that mate with integrally formed guides in the housing. Various automotive accessories, such as an automotive radio, also receive inputs from rocker switches, which, similar to button switches, have been painted and laser trimmed and also may create noise when a user actuates the rocker switch as the switch may engage a separate housing or a trim plate. Additionally, both button and rocker switches have generally required additional components (e.g., springs) to provide a desired feel.

Thus, what is needed is a parallel guide mechanism for a switch that provides noiseless actuation and guided movement and allows for material and/or component design that provides a desired actuation feel without increased component cost.

SUMMARY OF THE INVENTION embodiment of the present invention is directed to a parallel guide mechanism for a switch. In its basic embodiment, the parallel guide mechanism includes a peripheral housing and a central mass, located within the peripheral housing, for accepting a mechanical input from a user. The central mass moves responsive to the mechanical input. A first beam substantially located in a first plane extends from a first vertical surface of the central mass and connects the central mass to a first inner vertical surface of the peripheral housing. A second beam substantially located in the first plane is horizontally separated from the first beam by a first gap. The second beam extends from the first vertical surface of the central mass and connects the central mass to the first inner vertical surface of the peripheral housing. A third beam located in a second plane is vertically spaced apart from the first and second beams and is horizontally positioned in the first gap between the first and second beams. The third beam extends from the first vertical surface of the central mass and connects the central mass to the first inner vertical surface of the peripheral housing. The vertical distance between the third beam and the first and second beams is greater than the length of the first, second and third beams.

In another embodiment of the present invention, a switch cover is attached to a top surface of the central mass and a first electrically conductive contact is attached to a bottom surface of the central mass. The first electrically conductive contact contacts a second electrically conductive contact when the mechanical input from the user is of a sufficient force.

These and other features, advantages and objects of the present invention will be further understood and appreciated by those skilled in the art by reference to the following specification, claims and appended drawings.

BRIEF DESCRIPTION OF THE DRAWINGS

The present invention will now be described, by way of example, with reference to the accompanying drawings, in which.

DESCRIPTION OF THE PREFERRED EMBODIMENT(s)

The present invention is directed to a parallel guide mechanism for a switch that provides noiseless actuation, even guided movement and can be readily designed to provide a desired actuation feel. In at least one embodiment, all components of the mechanism are advantageously integrated to eliminate assembly and are designed such that replacement buttons can be readily installed if a decorating error occurs. The parallel guide mechanism allows for off-center actuation to provide enhanced lighting without loss of even actuation. Additionally, the design of the parallel guide mechanism eliminates typical concerns associated with parallel guide mechanisms. That is, a problem with parallel guide mechanisms is that they have not generally been capable of being molded without the use of slides. According to the present invention, a unique geometry has been developed that employs offset parallel beams that allow for molding without slides, while maintaining the advantage of the parallel guide feature. The parallel guide mechanism can be made from a variety of materials, for example, the parallel guide mechanism can be made from a metal, a hard plastic or a rubber. Further, the beams that attach the central mass to a peripheral housing can be adjusted in width, length, thickness and number to provide a desired feel.

Figure 1:
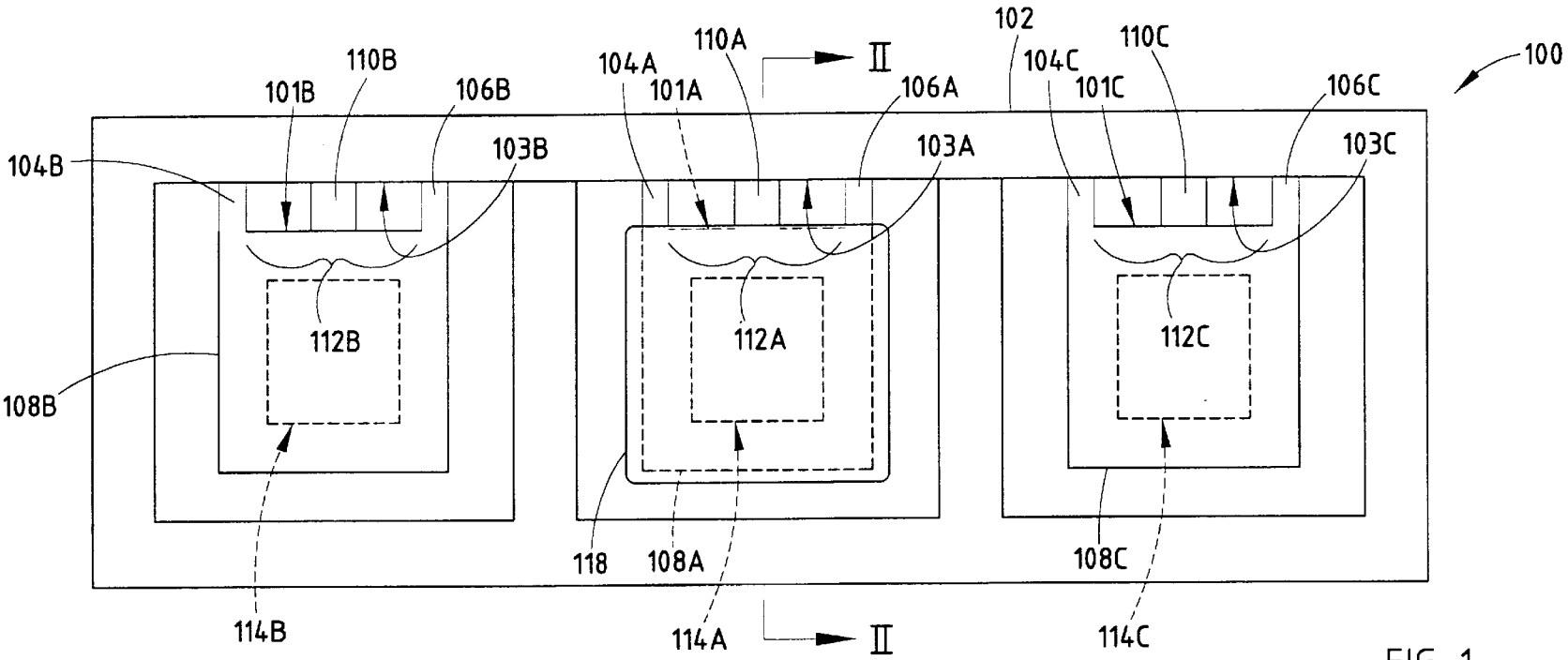
FIG. 1 is a top view of a parallel guide mechanism for a switch that includes a peripheral housing with a plurality of central masses located therein.

FIG. 1 depicts a parallel guide mechanism 100, with a trim plate removed, that includes a peripheral housing 102 that includes a plurality of central masses 108A–108C. A first beam 104A and a second beam 106A, which are substantially located in a first plane, extend from a first vertical surface 101A of the central mass 108A and connect the mass 108A to a first inner vertical surface 103A of the housing 102. While three central masses 108A–108C are shown, it should be appreciated that any number of desired central masses can be located within the housing 102. A third beam 110A is located in a second plane that is vertically spaced apart from the first and second beams 104A and 106A. The third beam 110A is horizontally positioned in a first gap 112A between the first beam 104A and the second beam 106A. The third beam 110A extends from the first vertical surface 101A of the central mass 108A and connects the central mass 108A to the first inner vertical surface 103A of the peripheral housing 102 in the second plane. Preferably, the vertical distance between the third beam 110A and the first and second beams 104A and 106A is greater than the length of the first, second and third beams 104A, 106A and 110A, respectively. Preferably, the central mass 108A includes a central void 114A, which advantageously allows a light source to be placed within or beneath the void 114A so as to direct light into the void 114A and through a button cover 118. The central masses 108B and 108C are similarly constructed as the mass 108A and as such, are not further discussed herein. In a preferred embodiment, a combined moment of inertia of the first and second beams 104A and 106A is equal to the moment of inertia of the third beam 110A.

Figure 2B:
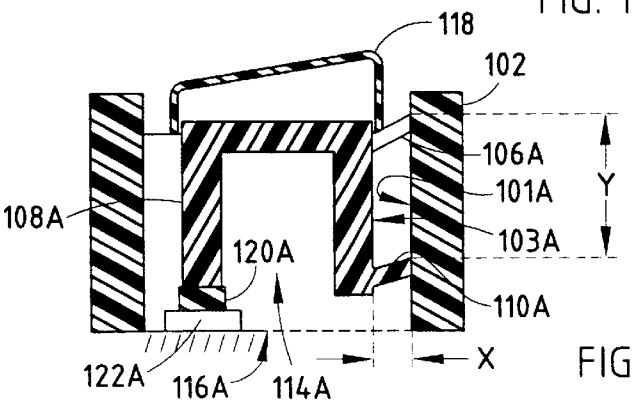
FIG. 2B is a cross-sectional view of the mechanism of FIG. 1, along the line II—II, with the central mass in deflection.
Figure 2A:
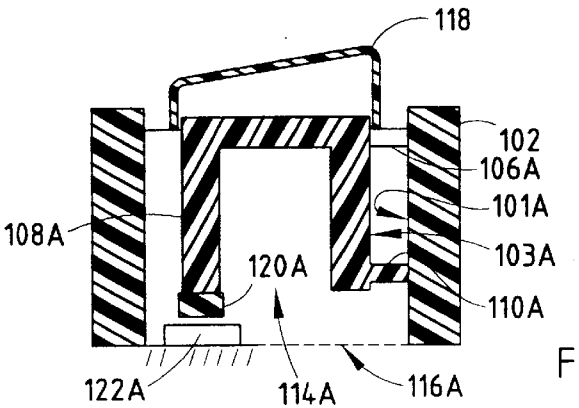
FIG. 2A is a cross-sectional view of the parallel guide mechanism of FIG. 1, along the line II—II.

FIG. 2A depicts the parallel guide mechanism 100 of FIG. 1, cross-sectioned along the line II—II. As shown, the central mass 108A includes the central void 114A. The second beam 106A attaches a top portion of the central mass 108A to the housing 102 and the third beam 110A connects a bottom of the central mass 108A to the housing 102. It should be appreciated that a parallel guide mechanism will adequately function with two parallel beams when the stiffness of the beams is the same and as long as the distance 'y' between the beams is greater than or equal to the length 'x' of the beams (see FIG. 2B). As designed, the bottom of the central mass 108A stays substantially parallel to the floor 116A when a force is applied to the cover 118, which is attached (or integrally formed with the central mass 108A) to the top of the central mass 108A.

FIG. 2B depicts a cross-section of the parallel guide mechanism of FIG. 2A when the beams 106A and 110A are in deflection due to a mechanical force being applied to a top surface of the cover 118. As shown in FIG. 2B, the central mass 108A is parallel to the floor 116A. As previously mentioned, while a parallel guide mechanism can be potentially fabricated with two beams, i.e., a top beam substantially over a bottom beam, due to molding constraints it is preferable to construct a parallel guide mechanism such that two beams are located toward a top (or a bottom) and a single beam is located toward a bottom (or the top) of a central mass. It should be appreciated that a different number of beams can be utilized providing that the parallel guide mechanism is moldable and the beams coupling the central mass to the housing are balanced. With reference again to FIG. 2A, a first electrically conductive contact 120A is preferably attached to a bottom surface of the central mass 108A and a second electrically conductive contact 122A is preferably located under the contact 120A such that when a sufficient mechanical force is applied to the top surface of the cover 118 the contact 120A makes contact with the contact 122A. The contact 122A is preferably coupled to an automotive accessory, which, responsive to the contact 120A making contact with the contact 122A, provides a discernable signal to the automotive accessory (e.g., a radio), which in response thereto, implements a specific function (e.g., a scan function).

Figure 3:
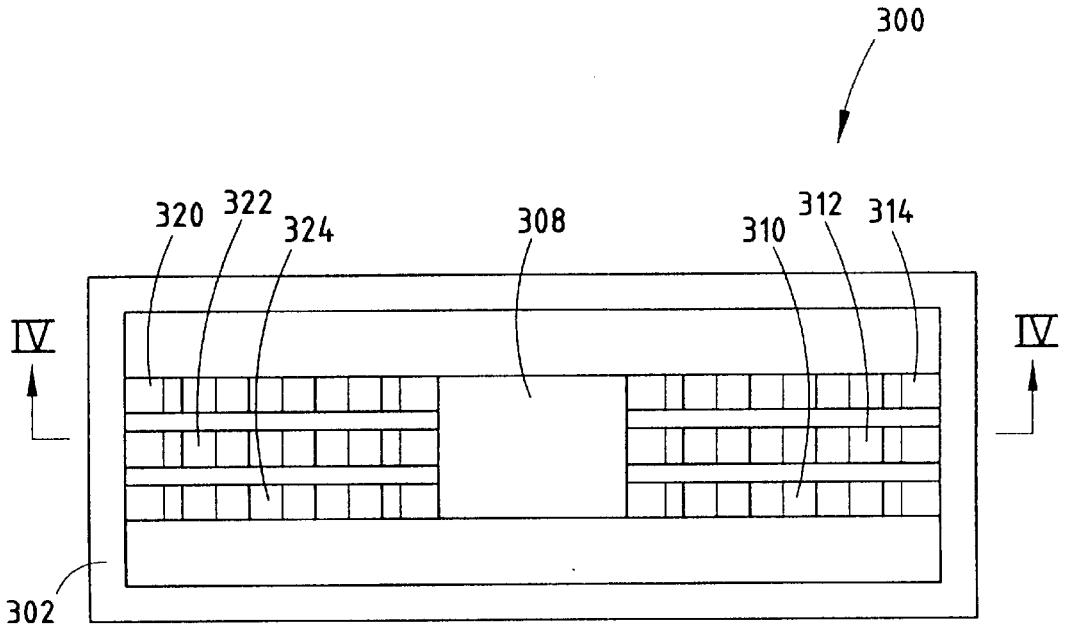
FIG. 3 is a top view of a parallel guide mechanism, according to another embodiment of the present invention.

FIG. 3 depicts a parallel guide mechanism 300, according to another embodiment of the present invention. A central mass 308, for accepting a mechanical input from a user, is located within a peripheral housing 302. In a preferred embodiment, the mechanism 300 is formed from a rigid molding material, for example, a metal, which allows for reduction of the beam length when the beams are spring shaped. As shown in FIG. 3, first and second beams 310 and 314 couple the central mass 308 to the peripheral housing 302 in a first plane and a third beam 312 couples the central mass 308 to the housing 302 in a second plane. Likewise, fourth and fifth beams 320 and 324 couple the mass 308 in the first plane on an opposite side of the housing 302. A sixth beam couples the mass 308 to the housing 302 in the second plane on the opposite side of the housing 302. It should be appreciated that in certain applications, only a single beam may be needed to couple the central mass 308 to the peripheral housing 302 on either side.

Figure 4:
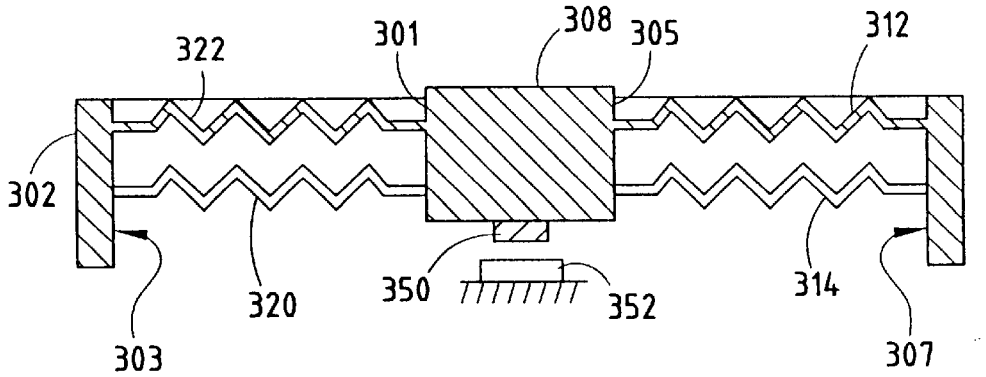
FIG. 4 is a cross-sectional view, along the line IV—IV of the mechanism of FIG. 3.

FIG. 4 depicts the mechanism 300 of FIG. 3 in cross-sectional view, along the line IV—IV. As shown in FIG. 4, the beams 314 and 320 are vertically offset from the beams 312 and 322. As shown in FIG. 4, a first electrically conductive contact 350 is coupled to a bottom of the central mass 308 and a second electrically conductive contact 352 is positioned beneath the contact 350 such that when a sufficient force is applied through a top surface of the central mass 308, the first contact 350 contacts the second contact 352. It will be appreciated that when the central mass 308 is made of a conductive material, the first contact 350 may not be needed depending upon the configuration of the central mass 308. Constructing the beams 310–314 and 320–324 in a spring shape allows for a reduction in the length of a beam as the spring shape reduces the force that would need to be applied to a top surface of the central mass; compared to a mechanism of the same beam length without the spring shape.

Figure 5:
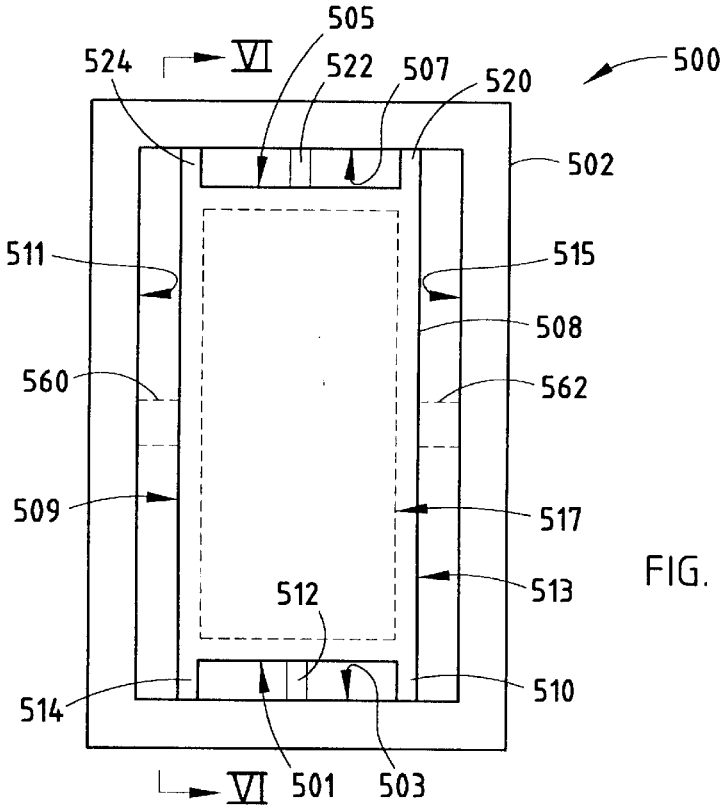
FIG. 5 is a top view of a parallel guide mechanism, according to yet another embodiment of the present invention.

FIG. 5 depicts a parallel guide mechanism 500 that can be utilized in a rocker switch design, according to another embodiment of the present invention. As shown, a central mass 508 is connected to a peripheral housing 502 by a number of beams 510–514 and 520–524. As with the mechanism of FIG. 1, the beams 520 and 524 are implemented in a first plane and the beam 522 is implemented in a second plane. The primary difference between the implementation in FIG. 1 and in FIG. 5 is that an opposite side of the central mass 508 includes beams 510 and 514 implemented in the first plane and a beam 512 implemented in the second plane coupling the central mass 508 to the housing 502. When implemented as a rocker switch, the mass 508 is also coupled in the middle of the mass 508 by a first load beam 560 and may also be coupled on an opposite side by a second load beam 562.

Figure 6:
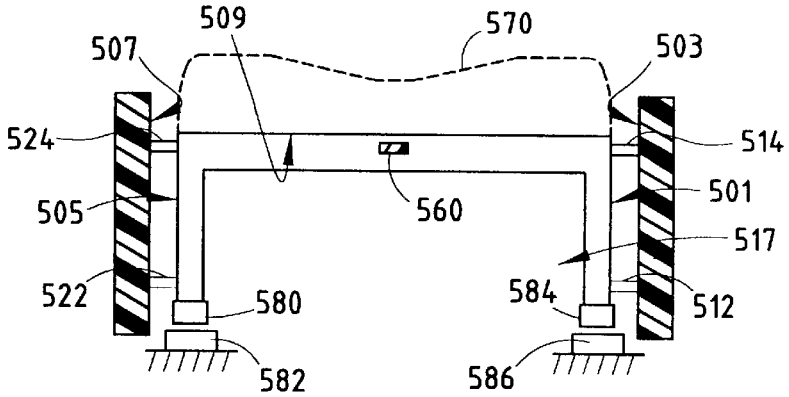
FIG. 6 is a cross-sectional view of the mechanism of FIG. 5, along the line VI—VI.

FIG. 6 is a cross-sectional view of the mechanism 500, along the line VI—VI. A rocker cover 570 is shown attached to the top surface of the central mass 508. A first contact 580 is attached to one end of the bottom surface of the central mass 508 and a second contact 584 is connected to an opposite end of the central mass 508. The first load beam 560, substantially located in the first plane and substantially positioned in a middle of the central mass 508, allows the central mass 508 to pivot about the middle of the central mass 508. When a sufficient force is applied to the rocker cover 570, nearer the beam 514, the second contact 584 makes contact with a fourth contact 586. When a sufficient force is applied to the rocker cover 570, nearer the beam 524, the mass 508 pivots about the center of the mass 508 and the first contact 580 contacts a third contact 582. In this manner, an automotive accessory, e.g., a radio, that has inputs coupled to the contacts 582 and 586 can determine when a user has activated the rocker switch and initiate an appropriate function in response thereto.

Figure 8:
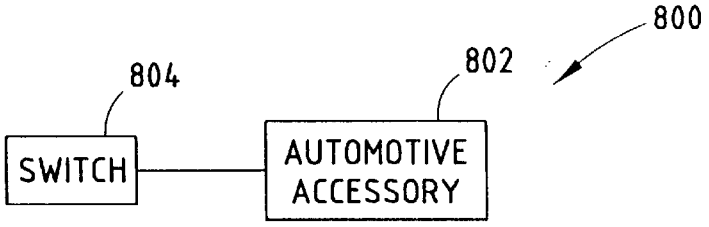
FIG. 8 is an electrical block diagram of a switch including a parallel guide mechanism coupled to an input of an automotive accessory 802, according to an embodiment of the present invention.
Figure 7:
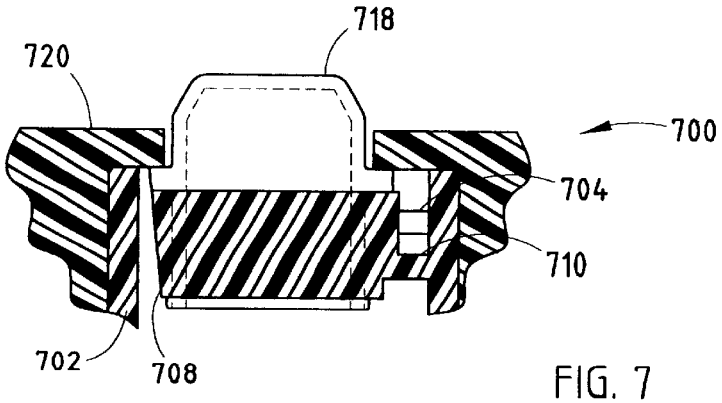
FIG. 7 is a cross-sectional view of the parallel guide mechanism of FIG. 1 taken along the line II—II, fabricated with a two-shot injection molding technique, according to yet another embodiment of the present invention.

FIG. 7 depicts a cross-sectional view of a parallel guide mechanism 700 that has been fabricated using a two-shot molding technique. For example, a first material such as an ABS/polycarbonate material can be utilized to form a housing 702 and a central mass 708 (including appropriate beams 704 and 710) in conjunction with an inserted button cover 718. A second material, such as a polycarbonate, can then be utilized to form a trim plate 720. In this manner, the mechanism 700 is fabricated in two shots. It should be appreciated that many other materials can be utilized to form the mechanism 700. FIG. 8 depicts an exemplary automotive subsystem 800 that includes an automotive accessory (e.g., a radio) 802 that receives an input from a switch 804, constructed according to the present invention (i.e., FIGS. 1–7).

Accordingly, a number of parallel guide mechanisms have been described, which can advantageously be used within an automotive subsystem for providing an input through a rocker switch and/or a button switch. The button and rocker (i.e., switch) covers can be integrated with the parallel guide mechanism reducing manufacturing costs. A switch constructed according to the present invention provides for noiseless actuation, even switch movement and can be designed to respond to a desired actuation pressure. Further, the actuator can be moved off center to provide enhanced lighting, without loss of even actuation.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

What is claimed is:

1. A parallel guide mechanism for a switch, comprising:

a peripheral housing;

a central mass for accepting a mechanical input from a user located within the peripheral housing, the central mass moving responsive to the mechanical input;

a first beam substantially located in a first plane, wherein the first beam extends from a first vertical surface of the central mass and connects the central mass to a first inner vertical surface of the peripheral housing;

a second beam substantially located in the first plane, wherein a first gap horizontally separates the second beam from the first beam, and wherein the second beam extends from the first vertical surface of the central mass and connects the central mass to the first inner vertical surface of the peripheral housing; and a third beam located in a second plane, wherein the third beam is vertically spaced apart from the first and second beams and is horizontally positioned in the first gap between the first and second beams, and wherein the third beam extends from the first vertical surface of the central mass and connects the central mass to the first inner vertical surface of the peripheral housing, where the vertical distance between the third beam and the first and second beams is greater than the length of the first, second and third beams.

2. The mechanism of claim 1, further including:

a switch cover attached to a top surface of the central mass; and a first electrically conductive contact attached to a bottom surface of the central mass, the first electrically conductive contact contacting a second electrically conductive contact when the mechanical input from the user is of sufficient force.

3. The mechanism of claim 2, further including:

a fourth beam substantially located in the first plane, wherein the fourth beam extends from a second vertical surface of the central mass which is opposite the first vertical surface and connects the central mass to a second inner vertical surface of the peripheral housing that is opposite the first inner vertical surface;

a fifth beam substantially located in the first plane, wherein a second gap horizontally separates the fifth beam from the fourth beam, and wherein the fifth beam extends from the second vertical surface of the central mass and connects the central mass to the second inner vertical surface of the peripheral housing;

a sixth beam located in the second plane, wherein the sixth beam is vertically spaced apart from the fourth and fifth beams and is horizontally positioned in the second gap between the fourth and fifth beams, and wherein the sixth beam extends from the second vertical surface and connects the central mass to the second inner vertical surface, where the vertical distance between the sixth beam and the fourth and fifth beams is greater than the length of the fourth, fifth and sixth beams;

a third electrically conductive contact attached to a bottom surface of the central mass, the third electrically conductive contact contacting a fourth electrically conductive contact when the mechanical input from the user is of sufficient force and is applied away from a center of the central mass toward the second vertical surface and the first electrically conductive contact contacting the second electrically conductive contact when the mechanical input from the user is of sufficient force and is applied away from the center of the central mass toward the first vertical surface; and a first load beam substantially located in the first plane and substantially positioned in a middle of the central mass, wherein the first load beam extends from a third vertical surface of the central mass and connects the central mass to a third inner vertical surface of the peripheral housing, where the central mass pivots about the first load beam when the mechanical input is applied away from the middle of the central mass.

4. The mechanism of claim 1, wherein a combined moment of inertia of the first and second beams is equal to the moment of inertia of the third beam.

5. The mechanism of claim 1, wherein the mechanism is formed by injection molding.

6. The mechanism of claim 1, wherein the mechanism is formed by machining.

7. The mechanism of claim 3, further including:

a second load beam substantially located in the first plane and substantially positioned in the middle of the central mass, wherein the second load beam extends from a fourth vertical surface of the central mass that is opposite the third vertical surface and connects the central mass to a fourth inner vertical surface of the peripheral housing that is opposite the third inner vertical surface, where the central mass pivots about the first and second load beams when the mechanical input is applied away from the middle of the central mass.

8. A switch, comprising:

a parallel guide mechanism including:

a peripheral housing;

a central mass for accepting a mechanical input from a user located within the peripheral housing, the central mass moving responsive to the mechanical input;

a first beam substantially located in a first plane, wherein the first beam extends from a first vertical surface of the central mass and connects the central mass to a first inner vertical surface of the peripheral housing;

a second beam substantially located in the first plane, wherein a first gap horizontally separates the second beam from the first beam, and wherein the second beam extends from the first vertical surface of the central mass and connects the central mass to the first inner vertical surface of the peripheral housing; and a third beam located in a second plane, wherein the third beam is vertically spaced apart from the first and second beams and is horizontally positioned in the first gap between the first and second beams, and wherein the third beam extends from the first vertical surface of the central mass and connects the central mass to the first inner vertical surface of the peripheral housing, where the vertical distance between the third beam and the first and second beams is greater than the length of the first, second and third beams;

a switch cover attached to a top surface of the central mass; and a first electrically conductive contact attached to a bottom surface of the central mass, the first electrically conductive contact contacting a second electrically conductive contact when the mechanical input from the user is of sufficient force.

9. The switch of claim 8, wherein a combined moment of inertia of the first and second beams is equal to the moment of inertia of the third beam.

10. The switch of claim 8, wherein the mechanism is formed by injection molding.

11. The switch of claim 8, wherein the mechanism is formed by machining.

12. The switch of claim 8, further including:

a fourth beam substantially located in the first plane, wherein the fourth beam extends from a second vertical surface of the central mass which is opposite the first vertical surface and connects the central mass to a second inner vertical surface of the peripheral housing that is opposite the first inner vertical surface;

a fifth beam substantially located in the first plane, wherein a second gap horizontally separates the fifth beam from the fourth beam, and wherein the fifth beam extends from the second vertical surface of the central mass and connects the central mass to the second inner vertical surface of the peripheral housing;

a sixth beam located in the second plane, wherein the sixth beam is vertically spaced apart from the fourth and fifth beams and is horizontally positioned in the second gap between the fourth and fifth beams, and wherein the sixth beam extends from the second vertical surface and connects the central mass to the second inner vertical surface, where the vertical distance between the sixth beam and the fourth and fifth beams is greater than the length of the fourth, fifth and sixth beams;

a third electrically conductive contact attached to a bottom surface of the central mass, the third electrically conductive contact contacting a fourth electrically conductive contact when the mechanical input from the user is of sufficient force and is applied away from a center of the central mass toward the second vertical surface and the first electrically conductive contact contacting the second electrically conductive contact when the mechanical input from the user is of sufficient force and is applied away from the center of the central mass toward the first vertical surface; and a first load beam substantially located in the first plane and substantially positioned in a middle of the central mass, wherein the second load beam extends from a third vertical surface of the central mass and connects the central mass to a third inner vertical surface of the peripheral housing, where the central mass pivots about the first load beam when the mechanical input is applied away from the middle of the central mass.

13. The switch of claim 12, further including:

a second load beam substantially located in the first plane and substantially positioned in the middle of the central mass, wherein the second load beam extends from a fourth vertical surface of the central mass that is opposite the third vertical surface and connects the central mass to a fourth inner vertical surface of the peripheral housing that is opposite the third inner vertical surface, where the central mass pivots about the first and second load beams when the mechanical input is applied away from the middle of the central mass.

14. An automotive subsystem, comprising:

a switch including:

a parallel guide mechanism including:

a peripheral housing;

a central mass for accepting a mechanical input from a user located within the peripheral housing, the central mass moving responsive to the mechanical input;

a first beam substantially located in a first plane, wherein the first beam extends from a first vertical surface of the central mass and connects the central mass to a first inner vertical surface of the peripheral housing;

a second beam substantially located in the first plane, wherein a first gap horizontally separates the second beam from the first beam, and wherein the second beam extends from the first vertical surface of the central mass and connects the central mass to the first inner vertical surface of the peripheral housing; and a third beam located in a second plane, wherein the third beam is vertically spaced apart from the first and second beams and is horizontally positioned in the first gap between the first and second beams, and wherein the third beam extends from the first vertical surface of the central mass and connects the central mass to the first inner vertical surface of the peripheral housing, where the vertical distance between the third beam and the first and second beams is greater than the length of the first, second and third beams;

a switch cover attached to a top surface of the central mass; and a first electrically conductive contact attached to a bottom surface of the central mass, the first electrically conductive contact contacting a second electrically conductive contact when the mechanical input from the user is of sufficient force; and an automotive accessory coupled to the second electrically conductive contact, the automotive accessory initiating a function when the first electrically conductive contact contacts the second electrically conductive contact.

15. The subsystem of claim 14, wherein a combined moment of inertia of the first and second beams is equal to the moment of inertia of the third beam.

16. The subsystem of claim 14, wherein the mechanism is formed by injection molding.

17. The subsystem of claim 14, wherein the mechanism is formed by machining.

18. The subsystem of claim 14, further including:

a fourth beam substantially located in the first plane, wherein the fourth beam extends from a second vertical surface of the central mass which is opposite the first vertical surface and connects the central mass to a second inner vertical surface of the peripheral housing that is opposite the first inner vertical surface;

a fifth beam substantially located in the first plane, wherein a second gap horizontally separates the fifth beam from the fourth beam, and wherein the fifth beam extends from the second vertical surface of the central mass and connects the central mass to the second inner vertical surface of the peripheral housing;

a sixth beam located in a second plane, wherein the sixth beam is vertically spaced apart from the fourth and fifth beams and is horizontally positioned in the second gap between the fourth and fifth beams, and wherein the sixth beam extends from the second vertical surface and connects the central mass to the second inner vertical surface, where the vertical distance between the sixth beam and the fourth and fifth beams is greater than the length of the fourth, fifth and sixth beams;

a third electrically conductive contact attached to a bottom surface of the central mass, the third electrically conductive contact contacting a fourth electrically conductive contact when the mechanical input from the user is of sufficient force and is applied away from a center of the central mass toward the second vertical surface and the first electrically conductive contact contacting the second electrically conductive contact when the mechanical input from the user is of sufficient force and is applied away from the center of the central mass toward the first vertical surface; and a first load beam substantially located in the first plane and substantially positioned in a middle of the central mass, wherein the second load beam extends from a third vertical surface of the central mass and connects the central mass to a third inner vertical surface of the peripheral housing, where the central mass pivots about the first load beam when the mechanical input is applied away from the middle of the central mass.

19. The subsystem of claim 18, wherein the mechanism further includes:

a second load beam substantially located in the first plane and substantially positioned in the middle of the central mass, wherein the second load beam extends from a fourth vertical surface of the central mass that is opposite the third vertical surface and connects the central mass to a fourth inner vertical surface of the peripheral housing that is opposite the third inner vertical surface, where the central mass pivots about the first and second load beams when the mechanical input is applied away from the middle of the central mass.

20. A method of supplying a parallel guide mechanism for a switch, comprising the steps of:

providing a peripheral housing;

providing a central mass for accepting a mechanical input from a user located within the peripheral housing, the central mass moving responsive to the mechanical input;

providing a first beam substantially located in a first plane, wherein the first beam extends from a first vertical surface of the central mass and connects the central mass to a first inner vertical surface of the peripheral housing;

providing a second beam substantially located in the first plane, wherein a first gap horizontally separates the second beam from the first beam, and wherein the second beam extends from the first vertical surface of the central mass and connects the central mass to the first inner vertical surface of the peripheral housing; and providing a third beam located in a second plane, wherein the third beam is vertically spaced apart from the first and second beams and is horizontally positioned in the first gap between the first and second beams, and wherein the third beam extends from the first vertical surface of the central mass and connects the central mass to the first inner vertical surface of the peripheral housing, where the vertical distance between the third beam and the first and second beams is greater than the length of the first, second and third beams.

* * * * *